United States Patent [19]

Mills

[11] Patent Number: 4,606,360

[45] Date of Patent: Aug. 19, 1986

[54] COUNTING AND WRAPPING OF COINS

[76] Inventor: Pearson O. Mills, 39 Lyncroft Rd., New Rochelle, N.Y. 10804

[21] Appl. No.: 597,268

[22] Filed: Apr. 6, 1984

[51] Int. Cl.[4] ..... B65B 1/04; B65B 35/50

[52] U.S. Cl. ..... 133/1 A; 53/254

[58] Field of Search ..... 133/1 R, 1 A, 8 A; 53/212, 213, 254

[56] References Cited

U.S. PATENT DOCUMENTS

| | | | |
|---|---|---|---|
| 961,832 | 6/1910 | Ayres | 133/1 A X |
| 1,077,968 | 11/1913 | Bisland . | |
| 1,084,569 | 1/1914 | Batdorf . | |
| 1,274,615 | 8/1918 | Sherwood | 53/254 X |
| 1,450,111 | 3/1923 | Parker . | |
| 1,457,261 | 5/1923 | Matthews | 133/1 A X |
| 1,710,086 | 4/1929 | Downey . | |
| 1,919,963 | 7/1933 | Smith | 53/254 |
| 2,150,473 | 3/1939 | Wagner | 133/1 A X |
| 2,355,201 | 8/1944 | Blackstone . | |
| 2,444,804 | 7/1948 | Carruthers | 133/1 A X |
| 2,532,603 | 12/1950 | Carper . | |
| 2,678,525 | 5/1954 | Sheldon . | |
| 2,977,736 | 4/1961 | Condis | 133/1 A X |
| 2,996,864 | 8/1961 | Cook | 53/212 X |
| 3,206,914 | 9/1965 | Norris | 53/254 |
| 3,967,435 | 7/1976 | Bergmaier . | |
| 4,091,599 | 5/1978 | Lemieux | 133/1 A X |
| 4,244,157 | 1/1981 | Vondra et al. | 133/1 A X |

*Primary Examiner*—F. J. Bartuska

*Attorney, Agent, or Firm*—Ladas & Parry

[57] ABSTRACT

A coin counting and wrapping device comprising a cylindrical coin stacking tube and a cooperating plug assembly. One end of the tube is open to receive coins and the other end has an opening of reduced diameter sufficiently dimensioned to prevent stacked coins from passing therethrough. The plug assembly is stepped to present a leading end dimensioned to pass through the reduced opening at one end of the tube and thereby raise a stack of coins accommodated in the tube. The plug assembly further comprises a cylindrical portion dimensioned to nest within a coin wrapper of paper or like material and terminating in a flared or bevelled surface adapted outwardly to flare one end of the coin wrapper and thereby facilitate insertion of the wrapper over a stack of aligned coins.

4 Claims, 5 Drawing Figures

COUNTING AND WRAPPING OF COINS

Figure 1:
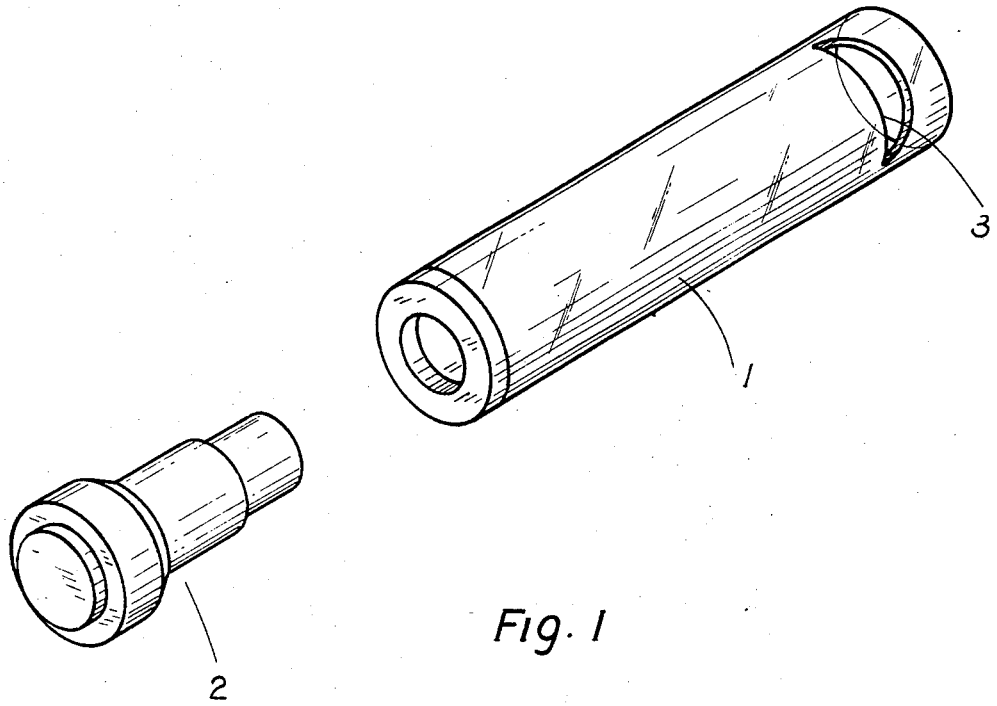

The present invention relates to the counting and wrapping of coins.

Banks, supermarkets and other retail stores and commercial common carriers amass large quantities of coins in their day-to-day transactions and it is necessary to collate, count and wrap these coins from large pools of such coins. It will be appreciated that these are only three examples of commercial establishments in which it is necessary to count coins. On a much smaller scale, individual citizens, not necessarily engaged in business, can accumulate a large number of coins of varying denominations. The most commonly accumulated coins are pennies which are received in change and have to be wrapped in bags of fifty before they can be deposited in bulk in a bank. For the sake of convenience, this invention will be described with particular application to the counting and wrapping of pennies. It will, of course, be appreciated that the invention is equally applicable to the counting and wrapping of coins of different denominations.

Various coin counting and wrapping devices have been proposed ranging from simple coin receiving tubes to complex hopper-fed sorting and counting machines. The present invention is particularly concerned with a small portable device which can be made available to all households but also finds particular utility in commercial establishments.

The coin counter and wrapping device of the invention makes it possible to assemble a predetermined number of coins in a stack and then insert the stack into a coin wrapper.

U.S. Pat. Nos. 4,091,599, 1,084,569, 2,444,804, 3,967,435, 2,996,864, 1,457,261, 1,077,968 and 3,206,914 are typical of prior art coin counting and/or wrapping devices in which coins are assembled in a stacked column within a tube and then transferred from the tube to a coin wrapper. These prior United States Patents are exemplary of prior art devices which operate on this principle but none discloses an easy mode of transfer from the tube to the wrapper. The present invention provides a substantial advantage over all these prior art devices by substantially simplifying transfer of the stacked coins from a stacking tube to a wrapper.

According to the present invention there is provided a method of wrapping a predetermined number of coins including the steps of stacking a plurality of coins in a column, removing from said stacked column coins in excess of said predetermined number, assembling a tubular coin wrapper in a coin receiving position, flaring a leading end of said coin wrapper, sliding said flared end over the stack of coins until all coins are within said wrapper and folding the ends of the wrapper over the end coins of said stack.

According to a further aspect of the invention there is provided a coin counting and wrapping device including a tubular container having an open top end and a partially closed bottom end and being dimensioned to accommodate a stack of coins, means for limiting the coins in the stack to a predetermined number, a plug member shaped and dimensioned selectively to enter said bottom end of the tubular container to raise a stack of coins contained therein and to nest within a coin wrapper to hold said wrapper in a coin receiving position, said plug member including means for flaring an end of said coin wrapper to facilitate insertion over a stack of coins.

Figure 5:
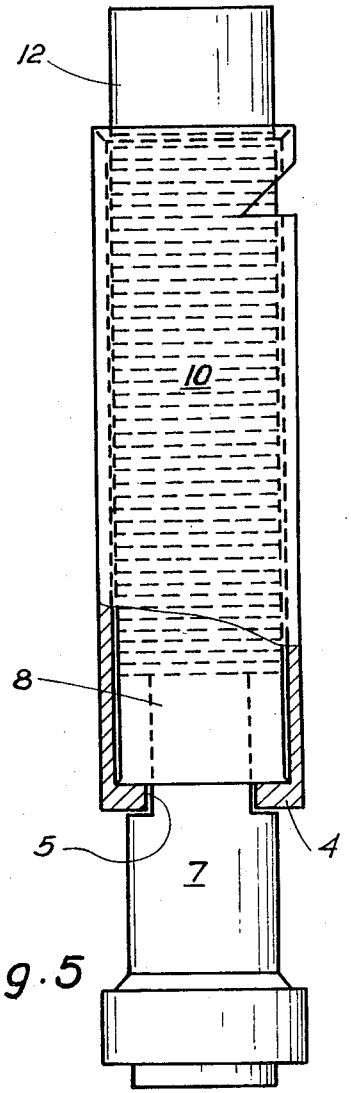
Figure 4:
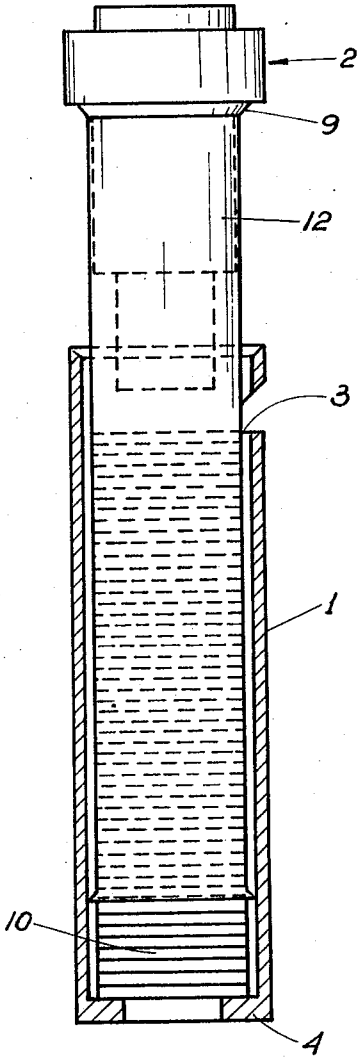
Figure 3:
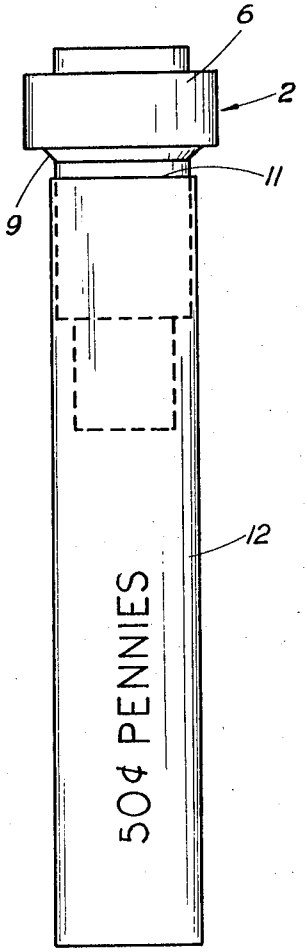
Figure 2:
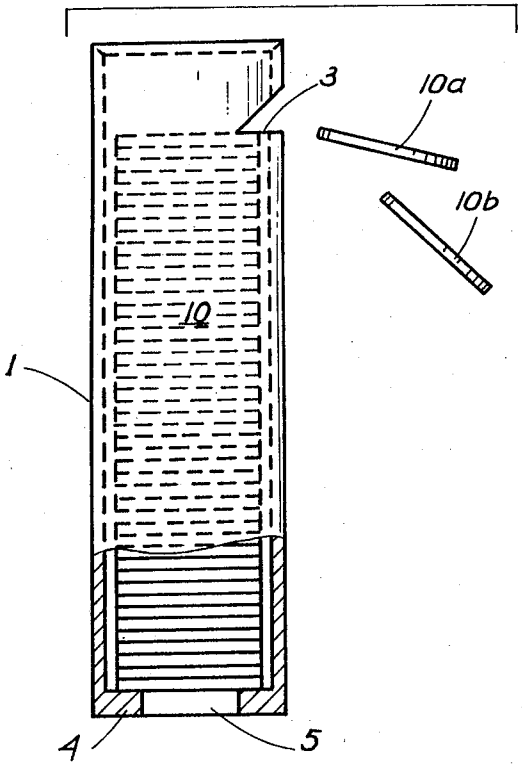

In order that the present invention may be more clearly understood and readily carried into effect, a preferred embodiment will now be described with reference to the accompanying drawings in which:

FIG. 1 is a perspective view of the component parts of one embodiment of the invention, FIG. 2 is a side elevation of one of the component parts shown in FIG. 1, FIG. 3 is a side elevation of the other component part shown in FIG. 1, said other component part being shown inserted in a coin wrapper or sheath, FIG. 4 is a side elevation of the component parts shown during an initial stage of a coin wrapping procedure, and FIG. 5 shows the component parts of FIG. 4 in an inverted position and in a subsequent coin wrapping stage.

The coin wrapping device of the invention consists essentially of a coin accommodating tube 1 and a mating plug assembly 2. The tube 1 is advantageously made of transparent plastics material and has a counting lip 3.

The tube is totally open at one end and has an inwardly directed rim or flange 4 at the opposite end which defines an opening 5 of smaller diameter than the totally open opposite end. The diameter of the totally open end is slightly larger than the diameter of coins intended to be stacked in the tube.

The plug assembly 2 comprises a plurality of juxtaposed stepped cylindrical portions symmetrically disposed about a common longitudinal axis. The largest cylindrical portion 6 is located proximate one end of the plug assembly and is intended to provide a gripping surface. An intermediate cylindrical portion 7 lies adjacent the largest cylindrical portion 6 and serves to space that largest cylindrical portion 6 from the smallest cylindrical portion which constitutes the leading end 8 of the plug assembly. An inwardly tapered bevelled surface 9 separates the largest cylindrical portion 6 from the intermediate cylindrical portion 7.

Whilst the largest cylindrical portion 6 is shown as having a plain periphery, it will be appreciated that a knurled or similar gripping surface may be provided. Also, the counting lip 3 is shown in the form of a substantially crescent-shaped slot with the lower edge forming the lip portion lying in the radial plane of the tube. The slot defining the lip can have any convenient configuration just so long as the lip 3 lies in the radial plane of the tube 1 at a distance spaced from the inner surface of the flange 4 by a distance equal to the depth of a stack of coins to be counted. In the specific example to be described in detail hereinafter, the coin wrapping apparatus is to be used to count and bag fifty pennies. Thus, in such an embodiment, the distance between the lip 3 and inner surface of the flange 4 is fifty times the thickness of a penny.

The procedure followed in counting and wrapping a stack of coins is best shown in FIGS. 2 through 5 of the drawings. FIG. 2 shows the tube 1 accommodating a stack of coins with the lowermost coin seated on the inwardly directed surface of the rim 4 and the uppermost coin flush with the lip 3. FIG. 2 schematically shows surplus coins 10*a* and 10*b* falling through the slot which is bordered by the lip 3. It will be appreciated that if more than the desired number of coins are inserted into the tube, then the stack of coins will rise above the lip 3 and simple tilting of the loaded tube 1 will cause the surplus coins to fall outwardly through the slot with the lip 3 retaining the uppermost of the predetermined number of stacked coins. Loading the stack of coins 10 into the tube 1 is made easy by the fact that the tubes end remote from the rim 4 is totally open and the inner diameter of the tube is slightly greater than the diameter of the coins to be accommodated.

Once the tube 1 is loaded with a stack of coins 10 it is temporarily set aside while the second stage of the coin wrapping procedure is formed. In this second stage, the plug assembly 2 is inserted into a coin wrapper of paper or like material. Such coin wrappers are available in banks and are dimensioned conveniently each to accommodate fifty coins. The dimensions of the leading end and the intermediate cylindrical portion 7 of the plug assembly 2 are such that said intermediate cylindrical portion 7 will nest within the open end 11 of a paper coin wrapper 12 in the manner most clearly shown in FIG. 3 of the drawings. In the Figure the end 11 of the coin wrapper is shown spaced from the bevelled surface 9 which interconnects the cylindrical portions 6, 7 of the plug assembly 2. Upon pushing the plug assembly 2 further into the coin wrapper 12, the end 11 of the coin wrapper will first contact the bevelled surface 9 and then partially ride over that bevelled surface. Relative rotation between the plug assembly 2 and the coin wrapper 12 will encourage the end 11 of the coin wrapper to flare outwardly as it tends to conform to the configuration of the bevelled surface 9. As will be apparent hereinafter, this is a particularly important step in the coin wrapping procedure.

Having caused the end 11 of the coin wrapper 12 to flare outwardly, the plug assembly 2 is then removed from that end of the coin wrapper and is inserted in the opposite end. Again, the coin wrapper seats over the intermediate portion 7 of the plug assembly 2 and, as shown in FIG. 4 of the drawings, abuts against the bevelled surface 9.

The plug assembly 2 with the coin wrapper 12 seated thereon is then inverted and the flared end of the coin wrapper is introduced into the open end of the tube 1 and is lowered downwardly through the tube and over the stack of coins 10 accommodated therein. During this lowering movement, the flared end of the coin wrapper becomes the leading end and the outwardly flaring assists in sliding the coin wrapper downwardly over the stack of coins. When the flared leading end of the coin wrapper abuts the flange 4 the plug assembly 2 is withdrawn from the trailing end of the coin wrapper whilst the wrapper remains surrounding the stack of coins 10 within the tube 1. The plug assembly is then inverted with respect to the tube 1 to adopt the position shown in FIG. 5. With the plug assembly in this position, the leading end 8 is introduced through the opening 5 and is pushed upwardly until the stepped portion between the leading end 8 and the intermediate cylindrical portion 7 of the plug assembly abuts the outer surface of the flange 4. During this upward pushing movement, the portion of the coin wrapper 12 which projects from the upper end of the tube is held and restrained against any movement out of the tube. In this manner, the leading end 8 of the plug assembly will push the stack of coins 10 upwardly into the coin wrapper.

At the point at which the stepped portion between the leading end 8 and intermediate cylindrical portion 7 of the plug assembly abuts the flange 4, the uppermost coin of the stack 10 is substantially level with the open end of the tube 12. It is then an easy matter manually to collapse and fold that portion of the coin wrapper which projects from the upper open end of the tube 1 over the upper end of the stack 10. The entire assembly is then again inverted and the plug assembly is withdrawn. Thereupon the tube is lifted off the filled coin wrapper and the opposite end of the coin wrapper is spaced from the now uppermost coin in the stack 10 by an amount substantially equal to the length of the leading end 8 of the plug assembly 2 minus the depth of the flange 4. This free end of the coin wrapper is then similarly foled over and on to the stack of coins which is now firmly wrapped.

I claim:

1. A coin counting and wrapping device including a tubular container dimensioned to accommodate a stack of coins with sufficient clearance between the external peripheral surface of the coin stack and the internal peripheral wall surface of the container to introduce a paper-like coin wrapper, said container being open at one end to receive coins and being partially closed at the opposite end to prevent coins falling therethrough, said container further having an opening extending through the peripheral wall thereof to define a lip spaced from said partially closed end by a distance equal to the desired height of a stack of coins whereby coins in excess of the desired number may be removed from the stack prior to wrapping, and wherein the device further includes a plug member arranged to cooperate with said container, said plug member comprising coaxially aligned cylindrical portions of differing diameter and including an outermost cylindrical portion of smallest diameter dimensioned to pass through an axial opening in the partially closed container end, an intermediate portion of greater diameter dimensioned on the one hand so as not to pass through said axial opening and on the other hand snugly to fit within an opened paper-like wrapper and hold said wrapper in the opened condition and a third cylindrical portion of greater diameter than said intermediate portion, said intermediate and third portions merging with each other through a bevelled surface extending outwardly from the end of said intermediate portion remote from said outermost portion, the arrangement being such that coins may be inserted into the container through the open end to form a stack up to the level of the lip whereupon a coin wrapper may be prepared for insertion over the coin stack by pushing the wrapper on to and over the intermediate cylindrical portion of the plug member to abut and partially ride over the bevelled surface to flare the leading end of the opened wrapper outwardly, said plug member then being removed from the flared end and introduced into the opposite end of the wrapper to hold said wrapper open and enable the leading flared end to be introduced into the open end of the container and pass downwardly over the stack of coins therein to abut the container bottom whereupon the plug member is removed from the wrapper and the outermost cylindrical portion of the plug member is inserted through the axial opening in the container bottom to push the stack of coins upwardly further into the wrapper prior to folding the wrapper end remote from the container over the uppermost coin in the stack and thereafter removing the wrapper and coins and folding the opposite wrapper end over the opposite end coin in the stack.

2. A method of wrapping a predetermined number of coins including the steps of stacking a plurality of coins in a column in a tubular container, removing from said stacked column coins in excess of said predetermined number, assembling a tubular coin wrapper in a coin receiving position, flaring a leading end of said coin wrapper, placing said flared end over the stack of coins and sliding the wrapper, flared end first, downwardly into the space between said coin stack and the internal walls of the tubular container until all coins are wrapped within said wrapper and folding the ends of the wrapper over the end coins of said stack.

3. A method as claimed in claim 2, including the steps of pushing the stack of coins into the wrapper prior to folding the first wrapper end and thereafter folding the second wrapper end.

4. A coin counting and wrapping device including a tubular container having an open top end and a partially closed bottom end and being dimensioned to accommodate a stack of coins, a slot extending peripherally part way around the tubular container at a location spaced from the container bottom by a distance equal to the height of a stack of predetermined number of coins in such manner that coins in excess of said predetermined number will be discharged from the top of said stack through said slot, a plug member having axially aligned stepped first, second and third cylindrical portions, said first cylindrical portion being dimensioned axially to enter the opening in the bottom end of the container, said second cylindrical portion being dimensioned axially closely to fit within a coin wrapper to hold said wrapper in an open coin receiving condition, and said third cylindrical portion being of larger diameter than said first and second cylindrical portions and a bevelled surface interconnecting said second and third cylindrical portions to provide means for flaring an end of said coin wrapper to facilitate intertion over a stack of coins.

* * * * *